United States Patent [19]

Whelan

[11] 4,420,084

[45] Dec. 13, 1983

[54] JEWELRY HOLDING DEVICE

[76] Inventor: Elizabeth M. Whelan, 34631 Sequoia, McHenry, Ill. 60050

[21] Appl. No.: 378,645

[22] Filed: May 17, 1982

[51] Int. Cl.[3] ..... A47F 5/08; A47B 67/02; B65D 25/10; B65D 5/52

[52] U.S. Cl. ..... 206/566; 206/45.11; 206/486; 211/13

[58] Field of Search ..... 206/566, 45.11, 486; 211/13; 190/16

[56] References Cited

U.S. PATENT DOCUMENTS

| | | | |
|---|---|---|---|
| 3,081,881 | 3/1963 | Seeger | 211/13 |
| 3,497,074 | 2/1970 | Shaheen | 211/13 |
| 4,287,986 | 9/1981 | Beck | 206/566 |
| 4,324,446 | 4/1982 | Lesage | 206/566 |

*Primary Examiner*—William T. Dixson, Jr.
*Attorney, Agent, or Firm*—Terry R. Mohr

[57] ABSTRACT

A device for holding jewelry such as earrings for wearing in pierced ears has at least two frames with a rigid sheet mounted in each of the frames, with the rigid sheet having apertures for receiving the jewelry.

8 Claims, 2 Drawing Figures

JEWELRY HOLDING DEVICE

BACKGROUND OF THE INVENTION

This invention relates to a jewelry holding device, and more particularly to a device for holding earrings suitable for wearing in pierced ears.

The wearing of earrings dates back in history for a substantial period of time. Even today, earrings are in fashion.

While earrings are customarily worn in pairs with one earring in each ear, other manners of wearing earrings are also used. One earring may be worn in only one ear. On the other hand, more than one pair of earrings may be worn at a time.

Whatever the manner of wearing earrings, in today's society it is especially suitable to wear earrings in pierced ears. An ear is pierced surgically to leave a hole in the ear—generally in the earlobe. Consistent wearing of earrings for pierced ears keeps the hole in the ear available for use in holding an earring.

An earring suitable for wearing in a pierced ear has two components. The first component is a decorative component having at one end thereof a jewel or other suitable decoration secured thereto. At the other end of the first component is a slender, needlelike prong suitable for inserting through the pierced ear so that the decoration is on the outside of the ear and the point of the prong is adjacent the head of the earring wearer. The second component is a clamp device, which is removably fittable over the prong adjacent the wearer's head, so that the decorative component may be held in place.

The two-component characteristic creates problems with the storage and simple transportation of earrings for pierced ears. Especially desired storage is that which keeps the two components of the earring together and readily accessible to the wearer. To be readily accessible, the earrings must be available for use quickly while at the same time being capable of simple storage. Lack of such a storage facility hinders the consumer in the enjoyment of the use of the earrings. The problems are further compounded when more than one pair of earrings are required to be in storage.

Storage of earrings for pierced ears for commercial sales is also a problem. Storage requirements are frustrated by requirements of a quick display for sale purposes. Most of the storage requirements and the display requirements have contradictory features.

The consumer and commercial problems are further compounded when travel plans require the taking of a pierced earring collection. Not only must the storage facility be capable of quick display and safe storage, the storage facility must also be capable of being transported easily.

Thus it may be seen that the contradiction of requirements for a pierced earring storage device creates both commercial problems and consumer problems. It is desirable to solve those problems.

SUMMARY OF THE INVENTION

Therefore, it is an object of this invention to provide a device for holding earrings suitable for wearing in pierced ears.

A further object of this invention is to provide a device capable of keeping the two components of the earring for pierced ears together.

Still a further object of this invention is to provide a device capable of displaying earrings for pierced ears.

Yet a further object of this invention is to provide a device capable of having earrings for pierced ears accessible.

Also an object of this invention is to provide a device for transporting earrings suitable for wearing in pierced ears.

These and other objects of this invention are met by an earring holder having a rigid earring support member supported in a hinged frame whereby the frames being hinged together provide a standing mechanism for the earring holder.

BRIEF DESCRIPTION OF THE DRAWINGS

Throughout the drawing figures, when the same part appears in more than one figure the same numeral is applied thereto.

DESCRIPTION OF THE PREFERRED EMBODIMENTS

Figure 2:
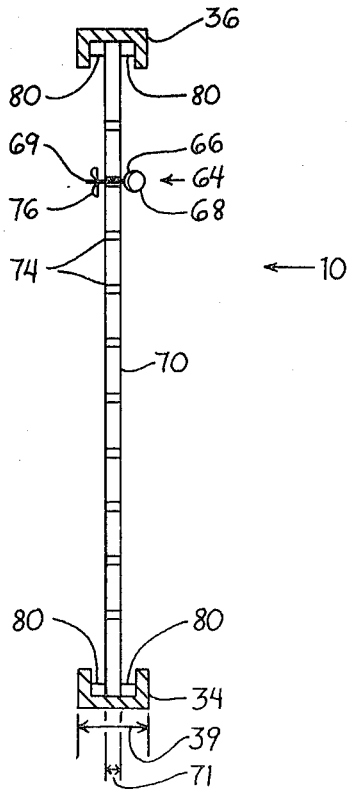
FIG. 2 is a cross-section of first frame 30 along line 2—2.

The device of this invention is particularly adapted for displaying and/or storing of earrings suitable for pierced ears. Typical of earrings for pierced ears of the post-type is an earring such as that shown in FIG. 2. The post-type pierced earring 64 includes a body portion comprising a base portion 66 and a decorative portion 68 secured thereto. Extending outwardly from the base portion 66 is a shaft 69. Shaft 69 is a relatively small elongated member suitable for fitting through the hole in the pierced ear of the wearer. Clip 76 fits on shaft 69 opposite base 66 and holds the earring 64 in place whether the earring 64 is fitting in the device 10 or in the ear of an earring wearer.

It is apparent that similar articles can be retained in device 10. Typical of those articles are tie tacks, decorative pins, name plates, military decorations, and other like articles having the relatively small diameter shaped portions combined with a holder.

Figure 1:
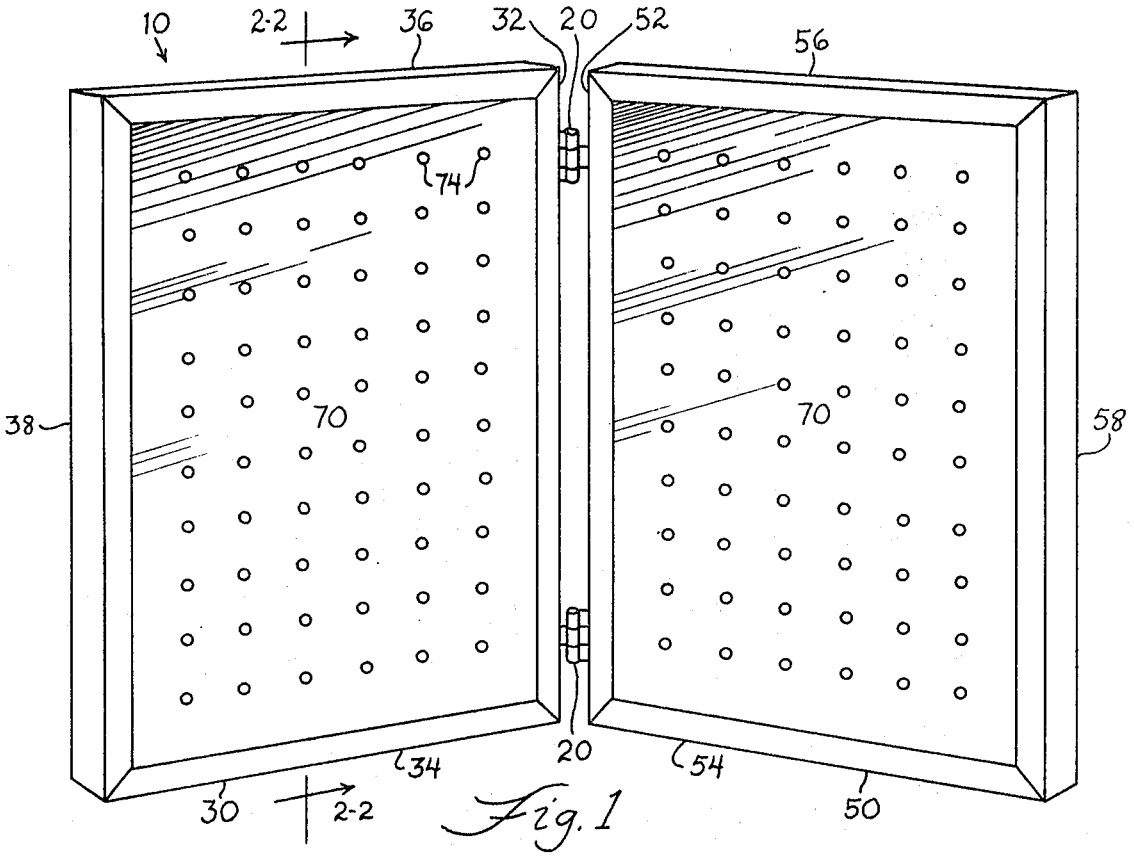
FIG. 1 is a perspective view of the earring holder device 10.

Referring now to FIG. 1, which shows a perspective view of earring holder device 10, it is seen that the first frame 30 is connected to second frame 50 by hinges 20. First frame 30 and second frame 50 may be of any suitable shape such that the device 10 may stand when frame 30 and frame 50 are in the open position as shown in FIG. 1. Because of hinges 20, it is possible to close first frame 30 and second frame 50 together into a book-like shape. In this fashion, the device 10 may be easily transported. In the open fashion, the earrings such as earring 64 are on ready display and available for use at the wearer's choice.

As above stated, frame 30 and frame 50 may be of any suitable shape. However, as is shown, it is preferred that they be of the rectangular shape and hinged together. It is also possible to have more than two frames and still provide the book-like folding capabilities of device 10.

Basically, first frame 30 has a hinged side 32 adjacent hinged side 52 of second frame 50. Bottom side 34 of first frame 30 and bottom side 54 of second frame 50 contact the surface on which device 10 is desired to be set. Top frame 36 of first frame 30 and top side 56 of second frame 50 are opposite their respective bottom sides. Closure side 38 of first frame 50 and second closure side 58 of second frame 50 complete the two rectangles.

Within the rectangles are earrings holders 70 secured in position halfway between the width of the frame by spacers 80. Spacers 80 (shown in FIG. 2) are glued or otherwise secured to the first frame 30 and second frame 50, and the earring holder 70. In this fashion, first frame 30 and second frame 50 can be folded together and not have the decorative portion 68 of pierced earrings such as earring 64 mounted in device 10 contact each other. The openness of the back portion of the frame permits ready access to the clip 76 and removal of the earring 64 from the device 10, while at the same time protecting clip 76 within first frame 30 or second frame 50. Thus, it may be seen that the earrings are readily available to the wearer or for display. Likewise, the display can be quickly removed and stored.

It follows that the frame thickness 39 must be substantially greater than the holder thickness 71 of holder 70. In this manner, holder 70 may be mounted about in the middle of frame thickness 39 and thereby achieve the goal of protecting clip 76, shaft 69 and decorative portion 68 of pierced earring 64, by having pierced earring 64 recessed within first frame 30 by second frame 50.

It is also possible to provide a box or a suitable closure for the device 10 when it is in folded condition. This box is a standard means readily available or designed by a person having ordinary skill in the art and is not shown here.

Earring holder 70 is generally thin enough to permit the shaft 69 of the earring 64 to pass through earring aperture 74 and have the clip 76 attached thereto in order to hold the earring 64 in place. As may be seen from FIG. 1, there are a plurality of earring apertures 74 within earring holder 70. Apertures 74 may be spaced differently in order to compensate for different types of a decorative portion 68.

Suitable materials for frame 30 or frame 50 are any materials or material having a rigidity sufficient to permit device 10 to stand and hold earring support 70. Spacer material 80 is likewise a suitably rigid material capable of being slipped in and glued (or otherwise secured to) the frame 30 or frame 50. Earring support 70 may be made of any thin, rigid material capable of having apertures 74 formed therein. Typical examples of the materials for the device 10 are metal, synthetic resins, or other similar rigid materials. The first frame 30 or second frame 50 may be made of transparent, translucent or opaque material. Any materials used in device 10 may have any appropriate decorative or utilitarian color, or mixtures thereof. The earring holder 70 may be made also of transparent, translucent, or opaque material. It is preferred, however, to have the material used for the earring holder 70 be at least translucent so that it may be judged which clip 76 is being touched while the earring 64 is being removed from the device 10. In this fashion, it is more easily determined which earring 64 is being removed.

From the structure of this invention, it can be seen that the frames and display characteristics of this invention overcome a number of problems noted in prior art. The device 10 permits a substantial number of pairs of earrings 64 to be easily transported or displayed. It also permits a safe storage means due to the recessed characteristics of the earring holder 70. Also due to the recess of earring holder 70, the first frame 30 and second frame 50 protect both the decorative portions 68 and the clip 76.

It is clearly possible to vary the presently described preferred embodiments of this invention. In view of this disclosure, the certain modifications may become apparent, and it is clear that those modifications are within the scope of this disclosure.

What is claimed and sought to be secured by Letters Patent of the United States is:

1. A device for holding jewelry comprising at least two frames, a jewelry holding means secured within said frames, and a securing means for attaching said frames together in an open display manner or a closed storage manner, said jewelry holding means being a rigid sheet, said frames being substantially thicker than said rigid sheet and said rigid sheet is secured within said frame at about the middle thereof to thereby permit said frames to protect a decorative portion of pierced earrings and a base portion of said pierced earrings or other jewelry.

2. The device of claim 1 wherein said frames are symmetrical.

3. The device of claim 2 wherein said rigid sheet has a plurality of jewelry receiving apertures therein and a thickness sufficient to support said pierced earrings or the like.

4. The device of claim 3 wherein said jewelry receiving apertures are spaced in a uniform pattern sufficiently to accept different types of pierced earrings and other jewelry.

5. The device of claim 4 wherein said frames are two in number.

6. The device of claim 5 wherein said frames are rectangular in shape.

7. The device of claim 6 wherein said securing means comprises at least two hinges.

8. The device of claim 7 further including a covering means for said device when said device is in said closed storage manner.

* * * * *